US006328398B1

(12) United States Patent
Chang

(10) Patent No.: US 6,328,398 B1
(45) Date of Patent: Dec. 11, 2001

(54) INK-JET RECORDING HEAD DRIVING METHOD AND INK-JET RECORDING DEVICE

(75) Inventor: Junhau Chang, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/395,176

(22) Filed: Sep. 14, 1999

(30) Foreign Application Priority Data

Sep. 22, 1998 (JP) ..... 10-268787

(51) Int. Cl.[7] ..... B41J 29/38; B41J 2/045
(52) U.S. Cl. ..... 347/11; 347/10; 347/68
(58) Field of Search ..... 347/9, 10, 11, 347/15, 68, 69

(56) References Cited

U.S. PATENT DOCUMENTS

| | | | | |
|---|---|---|---|---|
| 5,510,816 | | 4/1996 | Hosono et al. | 347/10 |
| 5,576,743 | | 11/1996 | Momose et al. | 347/11 |
| 6,161,912 | * | 12/2000 | Kitahara et al. | 347/9 |
| 6,217,141 | * | 4/2001 | Nakamura et al. | 347/10 |
| 6,257,687 | * | 7/2001 | Iwamura | 347/10 |

FOREIGN PATENT DOCUMENTS

| | | | |
|---|---|---|---|
| 0 812 689 A1 | 12/1997 | (EP) | B41J/2/045 |
| 0 841 164 A1 | 5/1998 | (EP) | B41J/2/045 |

* cited by examiner

*Primary Examiner*—John Barlow
*Assistant Examiner*—Alfred E. Dudding
(74) *Attorney, Agent, or Firm*—Sughrue, Mion, Zinn, Macpeak & Seas, PLLC

(57) ABSTRACT

An ink-jet recording head driving method and an ink-jet recording device wherein the quantity of ink composing an ink droplet can be reduced as much as possible without deteriorating the flying speed of an ink droplet and, consequently, a dot suitable for graphic printing can be formed. A pressure generating chamber is expanded or contracted by driving a piezoelectric layer provided on the pressure generating chamber communicating with a nozzle opening and a reservoir so as to jet an ink droplet from the nozzle opening. A preparatory process is provided for preparing for the jetting of ink by expanding a pressure generating chamber and backing a meniscus from the surface of the nozzle opening before a first contraction process for contracting the pressure generating chamber to jet ink from a nozzle opening. The quantity of ink composing an ink droplet can be reduced as much as possible without deteriorating the flying speed of the ink droplet by setting the duration of the preparatory process to ½ or less of Helmholtz vibrational cycle Tc of the pressure generating chamber and setting the volume of contraction in the first contraction process to 50% or less of the volume of expansion in the preparatory process. As a result, a dot suitable for graphic printing can be formed.

38 Claims, 11 Drawing Sheets

INK-JET RECORDING HEAD DRIVING METHOD AND INK-JET RECORDING DEVICE

BACKGROUND OF THE INVENTION

The present invention relates to an ink-jet recording head driving method and an ink-jet recording device wherein a piezoelectric element is formed on a part of a pressure generating chamber communicating with a nozzle opening from which an ink droplet is jetted via a diaphragm and an ink droplet is jetted by the displacement of the piezoelectric element.

Typically, an ink-jet recording head includes a pressure generating chamber communicating with a nozzle opening from which an ink droplet is jetted. The ink-jet recording head comprises a diaphragm which is deformed by a piezoelectric element and ink in a pressure generating chamber is pressurized to jet an ink droplet from a nozzle opening. Two variations of this type of ink-jet recording head are known. One such device uses a method whereby a piezoelectric actuator is used in a longitudinal vibration mode in which a piezoelectric element is extended or contracted in an axial direction. A second type uses a method whereby a piezoelectric actuator is used in a flexural vibration mode.

In the former method, the volume of a pressure generating chamber can be varied by touching the end face of a piezoelectric element to a diaphragm and a head suitable for high density printing can be manufactured. However, a problem arises with this method in that it is difficult to cut each piezoelectric element in the required shape, that of the teeth of a comb. This particular shape is required due to the arrangement pitch of nozzle openings. Further, it is difficult to position and attach the cut piezoelectric element onto a pressure generating chamber as required, leading to further complications in the manufacturing process.

The second known method provides the advantage that a piezoelectric element can be fixed onto a diaphragm in a relatively simple process. In this process, a piezoelectric material is baked resulting in a piezoelectric material corresponding to the shape of a pressure generating chamber.

However, not withstanding the advantages provided by the second method, there is a problem in that a piezoelectric actuator in the flexural vibration mode requires a larger area for displacement than a piezoelectric actuator in the longitudinal vibration mode. Consequently, the volume of a pressure generating chamber is increased and the quantity of ink in a jetted ink droplet is also increased, resulting in difficulties in forming the minute ink drop sizes required in certain graphics printing applications.

Further, there is also a problem in that the vibration of a meniscus after an ink droplet is jetted effects the jetting of the next ink droplet. To solve such problems, a driving method wherein vibrations are inhibited has been proposed. However, there is a problem in that the whole driving method is extended and cannot correspond to high frequency printing.

SUMMARY OF THE INVENTION

The present invention addresses the aforementioned problems by providing an ink-jet recording head driving method and an ink-jet recording device wherein the quantity of ink comprising an ink droplet is reduced as much as possible and the vibration of a meniscus after ink is jetted can be avoided, keeping a driving cycle short.

A preferred embodiment of the present invention relates to a method of driving an ink-jet recording head for contracting a pressure generating chamber by driving a piezoelectric element provided on the pressure generating chamber communicating with a nozzle opening and a reservoir and jetting an ink droplet. The invention further relates to an ink-jet recording head driving method characterized in that a process for preparing for the jetting of ink by expanding a pressure generating chamber and backing a meniscus from the surface of the nozzle opening is provided before a first contraction process for contracting the pressure generating chamber and jetting ink from a nozzle opening. The time in which a driving signal is applied in the preparatory process is equivalent to ½ or less of the Helmholtz vibrational cycle, Tc, of the pressure generating chamber and the quantity of contraction in the first contraction process is equivalent to 50% or less of the quantity of expansion in the preparatory process. According to this preferred embodiment, a small ink droplet can be effectively jetted.

An additional aspect of this embodiment of the present invention relates to an ink-jet recording head driving method wherein a second contraction process for contracting a pressure generating chamber so that the backing of a meniscus is reduced by reaction upon the first contraction process. According to this aspect, the backing of a meniscus after ink is jetted can be inhibited to prepare for the next jetting of ink and high speed stable driving can be realized.

Another aspect of this embodiment of the present invention relates to an ink-jet recording head driving method characterized in that the above second contraction process is started between time $t_1$ when the backing of a meniscus starts and time $t_2$ when the meniscus backs most respectively after the end of an ink droplet is jetted from a nozzle opening. According to this aspect, the backing of a meniscus after ink is jetted can be effectively inhibited and high speed stable driving can be realized.

An additional aspect of this embodiment of the present invention relates to an ink-jet recording head driving method characterized in that the above second contraction process is started in a range of $[t_1+(t_2-t_1)\times 3/4]$ from time $t_1$ when the backing of a meniscus starts after the end of an ink droplet is jetted from a nozzle opening. According to this aspect, the backing of a meniscus after ink is jetted can be more effectively inhibited and high speed stable driving can be realized.

Another aspect of this embodiment of the present invention relates to an ink-jet recording head driving method characterized in that the above-mentioned second contraction process is started in a range of $[t_1+(t_2-t_1)/2]$ from time $t_1$ when the backing of a meniscus starts after the end of an ink droplet is jetted from a nozzle opening. According to this aspect, the backing of a meniscus after ink is jetted can be more effectively inhibited and high speed stable driving can be realized.

Another aspect of this embodiment of the present invention relates to an ink-jet recording head driving method characterized in that after the above first contraction process, a process for gently contracting a pressure generating chamber is provided to a certain defined state including a reference state before the above preparatory process. According to this embodiment, a certain state is gently restored to the reference state after ink is jetted.

Yet another aspect of this embodiment of the present invention relates to an ink-jet recording head driving method wherein after the above second contraction process or after a certain state is restored to the above defined state, a first expansion process for expanding a pressure generating chamber so that vibration after ink is jetted is inhibited is provided. According to this embodiment, the vibration of a meniscus after ink is jetted can be effectively inhibited and the next jetting of ink can be prepared.

An additional aspect of this embodiment of the present invention relates to an ink-jet recording head driving method characterized in that time between the start of the above first contraction process and the start of the above first expansion process is substantially equivalent to Helmholtz vibrational cycle, Tc, of a pressure generating chamber. According to this embodiment, the vibration of a meniscus after ink is jetted can be effectively inhibited and the next jetting of ink can be prepared.

Another aspect of this embodiment of the present invention relates to an ink-jet recording head driving method wherein after the above first expansion process, a third contraction process for contracting a pressure generating chamber so that vibration after ink is jetted is inhibited is provided. According to this embodiment, the vibration of a meniscus after ink is jetted can be effectively inhibited and the next jetting of ink can be prepared.

Another aspect of this embodiment of the present invention relates to an ink-jet recording device provided with an ink-jet recording head for expanding or contracting a pressure generating chamber by driving a piezoelectric element provided on the pressure generating chamber communicating with a nozzle opening and a reservoir and jetting an ink droplet from the nozzle opening. Further, in accordance with this embodiment, a driving means is provided for executing a preparatory process for preparing for the jetting of ink by expanding a pressure generating chamber and backing a meniscus from the surface of the nozzle opening and a first contraction process for jetting ink from a nozzle opening by contracting the pressure generating chamber and for outputting a driving signal. The time when a driving signal is applied in the preparatory process is equivalent to ½ or less of Helmholtz vibrational cycle, Tc, of the pressure generating chamber and that the quantity of contraction in the first contraction process is equivalent to 50% or less of the quantity of expansion in the preparatory process to the piezoelectric element. According to this embodiment, a small ink droplet can be effectively jetted.

Another aspect of this embodiment of the present invention relates to an ink-jet recording device characterized in that the above driving means is provided with a second contraction process for contracting a pressure generating chamber so that the backing of a meniscus by reaction upon the above first contraction process is reduced. According to this embodiment, the backing of a meniscus after ink is jetted is inhibited, the next jetting of ink can be prepared and high speed stable driving can be realized.

Another aspect of this embodiment of the present invention relates to an ink-jet recording device characterized in that the above-mentioned second contraction process is started between time $t_1$ when the backing of a meniscus starts and time $t_2$ when the meniscus backs most respectively after the end of an ink droplet is jetted from a nozzle opening. According to this embodiment, the backing of a meniscus after ink is jetted can be effectively inhibited and high speed stable driving can be realized.

Another aspect of this embodiment of the present invention relates to an ink-jet recording device characterized in that the above second contraction process is started in a range of $[t_1+(t_2-t_1)\times 3/4]$ from time $t_1$ when the backing of a meniscus starts after the end of an ink droplet is jetted from a nozzle opening. According to this embodiment, the backing of a meniscus after ink is jetted can be further effectively inhibited and high speed stable driving can be realized.

Another aspect of this embodiment of the present invention relates to an ink-jet recording device characterized in that the above second contraction process is started in a range of $[t_1+(t_2-t_1)/2]$ from time $t_1$ when the backing of a meniscus starts after the end of an ink droplet is jetted from a nozzle opening. According to this embodiment, the backing of a meniscus after ink is jetted can be further effectively inhibited and high speed stable driving can be realized.

Another aspect of this embodiment of the present invention relates to an ink-jet recording device characterized in that after the above first contraction process, a process for gently contracting a pressure generating chamber is provided to a certain defined state including a reference state before the above preparatory process. According to this embodiment, after ink is jetted, a certain state is gently restored to the defined state.

Another aspect of this embodiment of the present invention relates to an ink-jet recording device characterized in that the above-mentioned driving means is provided with a first expansion process for expanding a pressure generating chamber so that vibration after ink is jetted is inhibited after the above-mentioned second contraction process or after a certain state is restored to the above defined state. According to this embodiment, the vibration of a meniscus after ink is jetted can be effectively inhibited and the next jetting of ink can be prepared.

Another aspect of this embodiment of the present invention relates to an ink-jet recording device characterized in that time between the start of the above first contraction process and the start of the above first expansion process is substantially equivalent to Helmholtz vibrational cycle Tc of a pressure generating chamber. According to this embodiment, the vibration of a meniscus after ink is jetted can be further effectively inhibited and the next jetting of ink can be prepared.

Another aspect of this embodiment of the present invention relates to an ink-jet recording device wherein after the above first expansion process, a third contraction process for contracting a pressure generating chamber so that vibration after ink is jetted is inhibited is provided. According to this embodiment, the vibration of a meniscus after ink is jetted can be further effectively inhibited and the next jetting of ink can be prepared.

Another aspect of this embodiment of the present invention relates to an ink-jet recording device characterized in that predetermined voltage is applied to a piezoelectric actuator in a state before and after the start of each of a series of processes executed by the above driving means. According to this embodiment, the pressure generating chamber is contracted and ink is jetted by the deformation by the application to the piezoelectric element of voltage or the release.

Another aspect of this embodiment of the present invention relates to an ink-jet recording device characterized in that a pressure generating chamber is contracted by deforming a piezoelectric actuator by applying a predetermined voltage. According to this embodiment, ink is jetted by contracting the pressure generating chamber expanded by applying voltage to the piezoelectric element by releasing the voltage.

Another aspect of this embodiment of the present invention relates to an ink-jet recording device characterized in that a pressure generating chamber is contracted by deforming a piezoelectric actuator by releasing a predetermined voltage applied to the piezoelectric actuator. According to this embodiment, ink is jetted by contracting the pressure generating chamber expanded by applying voltage to the piezoelectric element by releasing the voltage.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS

The present invention will be described in detail based upon embodiments below.

Figure 1:
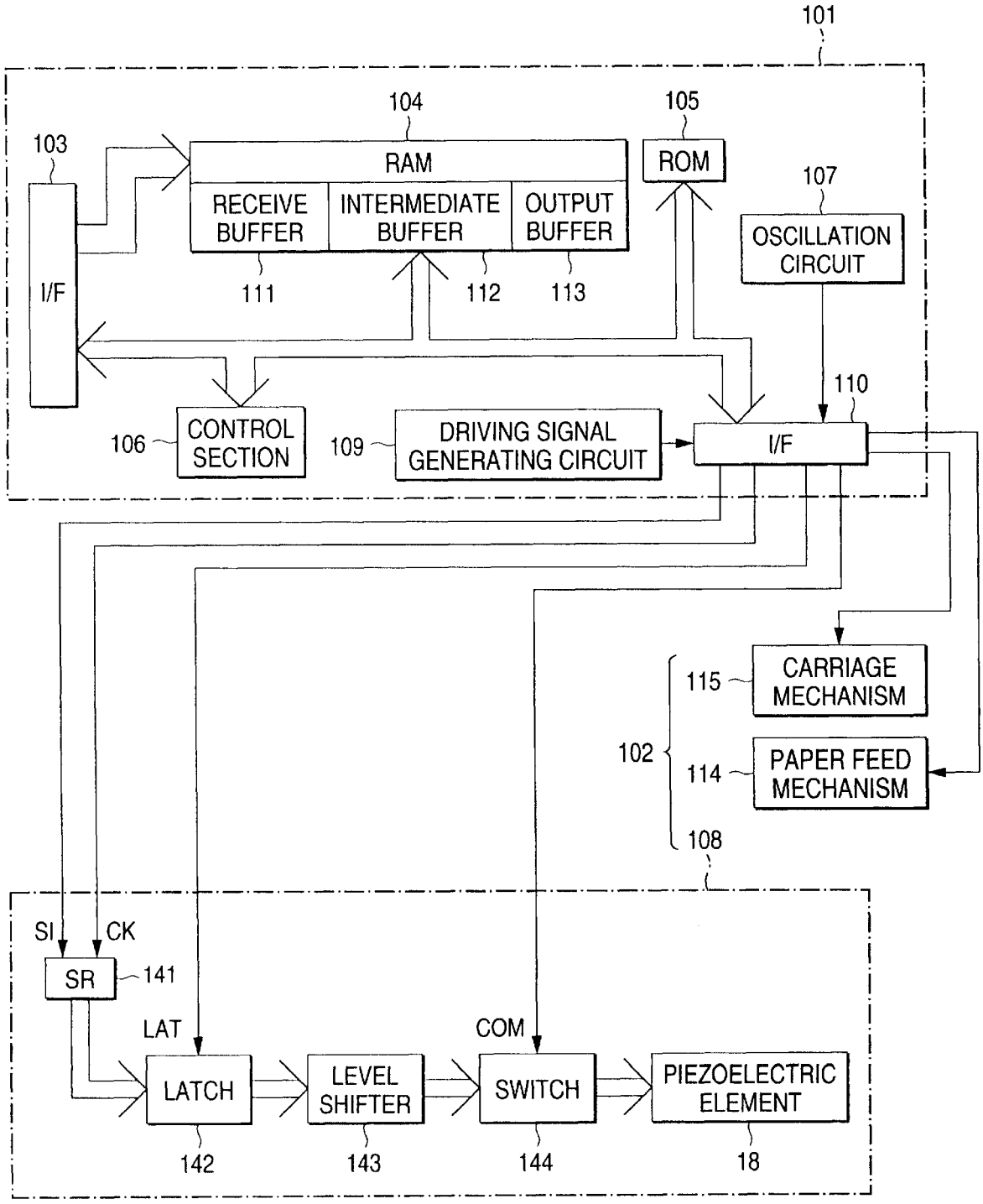
FIG. 1 is a block diagram showing the schematic configuration of an ink-jet recording device according to a first embodiment of the present invention.

FIG. 1 shows the schematic configuration of an ink-jet recording device in accordance with a first embodiment. As shown in FIG. 1, the above ink-jet recording device is schematically composed of a printer controller 101 and a printing engine 102.

The printer controller 101 is provided with an external interface 103, RAM 104 for temporarily storing various data, ROM 105 in which a control program and others are stored, a control section 106 composed by CPU and others, an oscillation circuit 107 for generating a clock signal, a driving signal generating circuit 109 for generating a driving signal to be supplied to an ink-jet recording head 108 and an internal interface 110 for sending dot pattern data (bit map data) based upon a driving signal and print data and others to the printing engine 102.

The external interface 103 receives print data composed of a character code, a graphic function, image data and others, for example, from a host computer not shown and others. Also, a busy signal (BUSY) and an acknowledge (ACK) are output to the host computer and others via the external interface 103.

RAM 104 functions as a receive buffer 111, an intermediate buffer 112, an output buffer 113 and a work memory not shown. The receive buffer 111 temporarily stores print data received by the external interface 103, the intermediate buffer 112 stores intermediate code data converted by the control section 106 and the output buffer 113 stores dot pattern data. The above dot pattern data is composed of print data acquired by decoding gradation data. As described later, print data in this embodiment is composed of a four-bit signal.

Font data, a graphic function and others are stored in addition to a control program (a control routine) for controlling the execution of various data processing in ROM 105.

The control section 106 reads print data in the receive buffer 111 and instructs the intermediate buffer 112 to store intermediate code data acquired by converting the print data. The control section 106 also analyzes the intermediate code data read from the intermediate buffer 112 and converts the intermediate code data to dot pattern data referring to font data and a graphic function and others respectively stored in ROM 105. The control section 106 instructs the output buffer 113 to store the converted dot pattern data after the control section instructs to execute required ornament processing.

If dot pattern data equivalent to one line of the ink-jet recording head 108 is acquired, the dot pattern data equivalent to one line is output to the ink-jet recording head 108 via the internal interface 110. When dot pattern data equivalent to one line is output from the output buffer 113, the converted intermediate code data is deleted from the intermediate buffer 112 and processing for converting the next intermediate code data is executed.

The printing engine 102 is composed of the ink-jet recording head 108, a paper feed mechanism 114 and a carriage mechanism 115.

The paper feed mechanism 114 is composed of a paper feed motor, a paper feed roller and others and sequentially feeds a print medium such as recording paper corresponding to the recording operation of the ink-jet recording head 108. That is, the paper feed mechanism 114 relatively shifts a print medium in a vertical scanning direction.

The carriage mechanism 115 is composed of a carriage which can mount the ink-jet recording head 108 and a carriage actuator for running the carriage in a horizontal scanning direction, and the ink-jet recording head 108 is moved in a horizontal scanning direction by running the carriage. The carriage actuator may be an arbitrary mechanism which can run a carriage such as a mechanism using a timing belt.

The ink-jet recording head 108 is provided with multiple nozzle openings in a vertical scanning direction and jets an ink droplet from each nozzle opening at timing defined depending upon dot pattern data and others.

The ink-jet recording head 108 described above will be described in detail below. First, referring to FIG. 3 showing the section of the main part, the mechanical composition of the ink-jet recording head 108 will be described.

Figure 3:
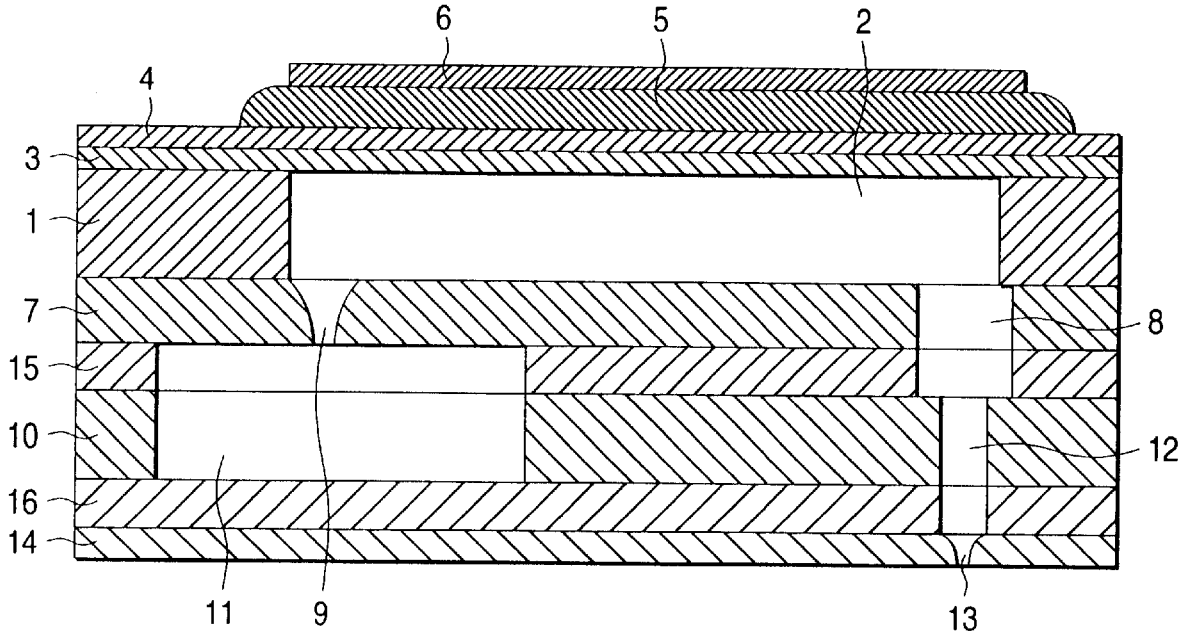
FIG. 3 is a sectional view showing the ink-jet recording head in accordance with the first embodiment of the present invention.

As shown in FIG. 3, a spacer 1 functioning as a substrate for forming a pressure generating chamber is formed by a ceramic plate provided with the thickness of approximately 150 $\mu$m for example and made of zirconia ($ZrO_2$) or others and a through hole to be a pressure generating chamber 2 is formed.

One side of the spacer 1 is sealed by an elastic plate 3 composed of a thin plate made of zirconia with the thickness of 10 $\mu$m for example and a lower electrode 4 is formed on the surface of the elastic plate 3. A piezoelectric layer 5 is fixed on the lower electrode 4 independently every pressure generating chamber 2. The piezoelectric layer 5 is formed by a method such as sticking a green sheet made of piezoelectric material and sputtering piezoelectric material. Further, an upper electrode 6 is formed on the surface of each piezoelectric layer 5. Therefore, each piezoelectric layer 5 is flexuously deformed together with the elastic plate 3 by applying voltage between the lower electrode 4 and the upper electrode 6 on the piezoelectric layer 5 provided every pressure generating chamber 2 based upon print data.

The other side of the spacer 1 is sealed by an ink supply port forming substrate 7 composed of a thin plate made of zirconia and provided with the thickness of 150 $\mu$m. A hole communicating with a nozzle 8 connecting a nozzle opening of a nozzle plate and the pressure generating chamber 2 and an ink supply port 9 connecting a reservoir 11 described later and the pressure generating chamber 2 are formed inside the ink supply port forming substrate 7.

In the meantime, a reservoir forming substrate 10, 15 is formed by a corrosion-resistant plate 150 $\mu$m thick made of stainless steel for example which is suitable for composing an ink passage and provided with the reservoir 11 to which ink is supplied from an external ink tank for supplying ink to the pressure generating chamber 2 and a hole communicating with a nozzle 12 connecting the pressure generating chamber 2 and a nozzle opening 13 described later. The side opposite the spacer 1 of the reservoir forming substrate 10, 15 is sealed by a nozzle plate 14 inside which nozzle openings 13 are formed at the same array pitch as the pressure generating chambers 2.

The above each member made of ceramics is sintered after it is laminated for integration, and the reservoir forming substrate 10 and the nozzle plate 14 are fixed via an adhesive layer 16. The reservoir forming substrate 10 and the nozzle plate 14 can be also integrated as a ceramic.

The ink-jet recording head 108 formed as described above is provided with a piezoelectric element 18 in a flexural vibration mode opposite to each pressure generating chamber 2. Electric information, for example a driving signal (COM) described later, print data (SI) and others are supplied to the piezoelectric element 18 via a flexible cable not shown.

In the ink-jet recording head 108 is composed as described above and the piezoelectric element 18 is flexuously deformed in a convex shape downward when voltage is applied to the piezoelectric element and the pressure generating chamber 2 is contracted. Pressure upon ink in the pressure generating chamber 2 is increased as the pressure generating chamber is contracted. In the meantime, the flexural deformation of the piezoelectric element 18 is restored by discharge and the contracted pressure generating chamber 2 is expanded. Ink in the reservoir 11 flows into the pressure generating chamber through the ink supply port 9 as the pressure generating chamber is expanded. As the volume of the pressure generating chamber 2 is varied by applying voltage to the piezoelectric element 18 or releasing the application to the piezoelectric element 18 of voltage as described above, an ink droplet in desired size can be jetted from a desired nozzle opening 13 by controlling the application to each piezoelectric element 18 of voltage or, under certain circumstances, the release of the application of the voltage.

Next, the electrical composition of the ink-jet recording head 108 will be described.

Figure 2:
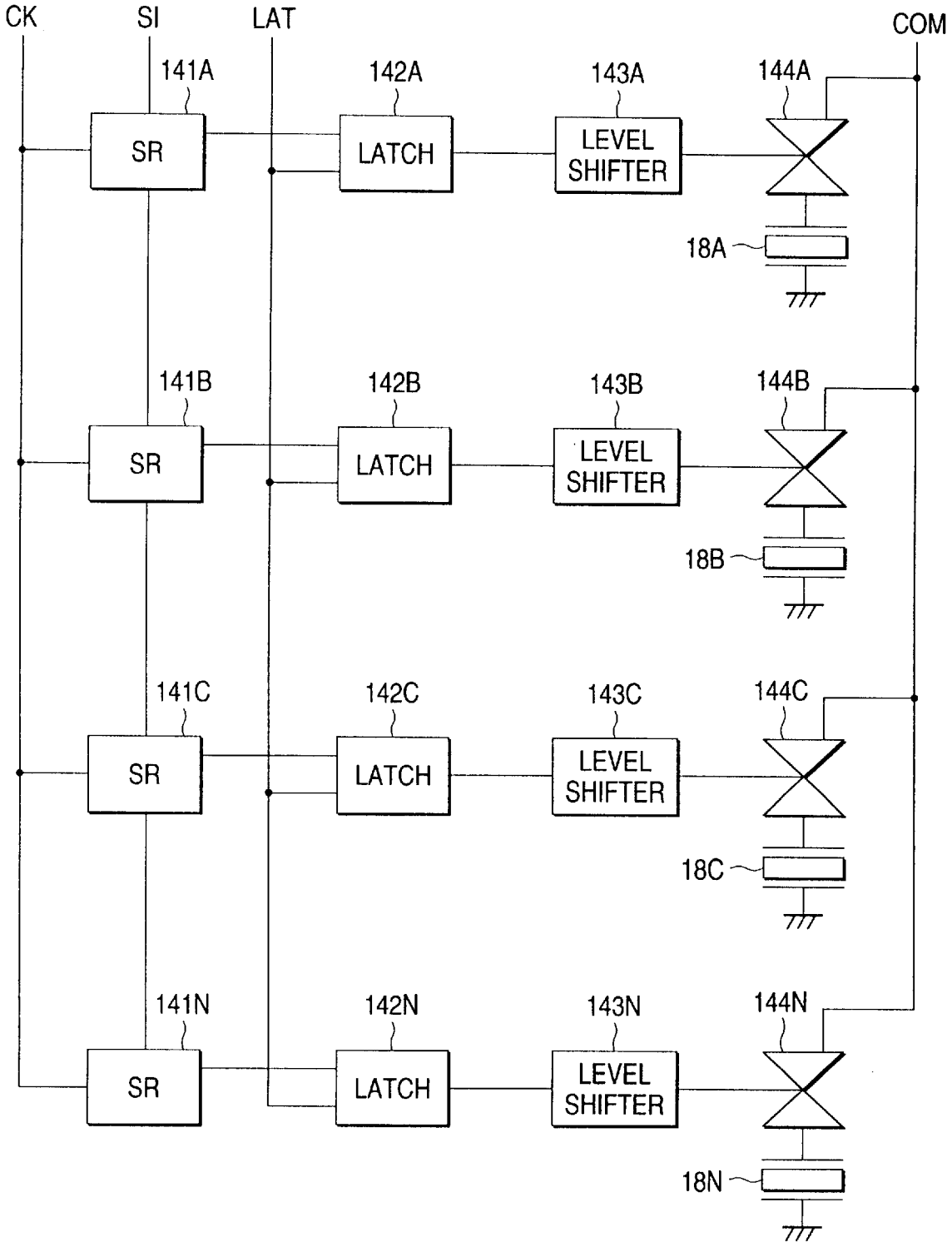
FIG. 2 is a circuit diagram showing the circuit configuration of an ink-jet recording head in accordance with the first embodiment of the present invention.

The ink-jet recording head 108 is provided with a shift register 141, a latch 142, a level shifter 143, a switch 144, the piezoelectric element 18 and others as shown in FIG. 1. Further, as shown in FIG. 2, the above shift register 141, the above latch 142, the above level shifter 143, the above switch 144 and the above piezoelectric element 18 are respectively composed of shift register elements 141 A to 141 N, latch elements 142A to 142N, level shifter elements 143A to 143N, switch elements 144A to 144N and piezoelectric elements 18A to 18N respectively provided every nozzle opening 13 of the ink-jet recording head 108, and electrically connected in the order of the shift register 141, the latch 142, the level shifter 143, the switch 144 and the piezoelectric element 18.

These shift register 141, latch 142, level shifter 143 and switch 144 generate a driving pulse based upon a driving signal generated by a driving signal generating circuit 109. The above driving pulse means a pulse actually applied to the piezoelectric element 18 and the above driving signal means a series of pulse signals (original driving pulses) provided with an original waveform required for generating a driving pulse. The switch 144 also functions as switching means.

In the recording head 108 provided with electrical composition as described above, as shown in FIG. 4(*a*), print data (SI) composing dot pattern data is serially transmitted from the output buffer 113 to the shift register 141 in synchronization with a clock signal (CK) from the oscillation circuit 107 and sequentially stored. In this case, first, the data of the highest-order bit in print data for all nozzle openings 13 is serially transmitted and when the serial transmission of the data of the highest-order bit is finished, the data of the second highest-order bit is serially transmitted. Similarly, the data of a lower-order bit is sequentially serially transmitted.

When the print data of the bit is stored in the shift register elements 141A to 141N for all nozzles, the control section 106 instructs to output a latch signal (LAT) to the latch 142 at predetermined timing. The latch 142 latches the print data stored in the shift register 141 according to the above latch signal. The print data (LATout) latched in the latch 142 is sent to the level shifter 143 for functioning as a voltage amplifier. If the print data is '1' for example, the level shifter 143 amplifies the print data up to a voltage value which can drive the switch 144, for example a few tens of volts. The amplified print data is sent to the switch elements 144A to 144N and the switch elements 144A to 144N are changed to a connected condition by the print data.

A driving signal (COM) generated by the driving signal generating circuit 109 is also applied to each switch element 144A to 144N and when the switch elements 144A to 144N are connected, a driving signal is respectively applied to the piezoelectric elements 18A to 18N respectively connected to the switch elements 144A to 144N.

As described above, in the above ink-jet recording head 108, it can be controlled by print data whether a driving signal is applied to the piezoelectric element 18 or not. As the switch 144 is kept connected by a latch signal (LAT) in a cycle in which print data is '1' for example, a driving signal (COMout) can be supplied to the piezoelectric element 18 and the piezoelectric element 18 is displaced (deformed) by the supplied driving signal (COMout). As the switch 144 is kept unconnected in a cycle in which print data is '0', the supply of a driving signal to the piezoelectric element 18 is interrupted. As each piezoelectric element 18 holds charge immediately before in a cycle in which print data is '0', the displaced state immediately before is maintained.

Figure 4:
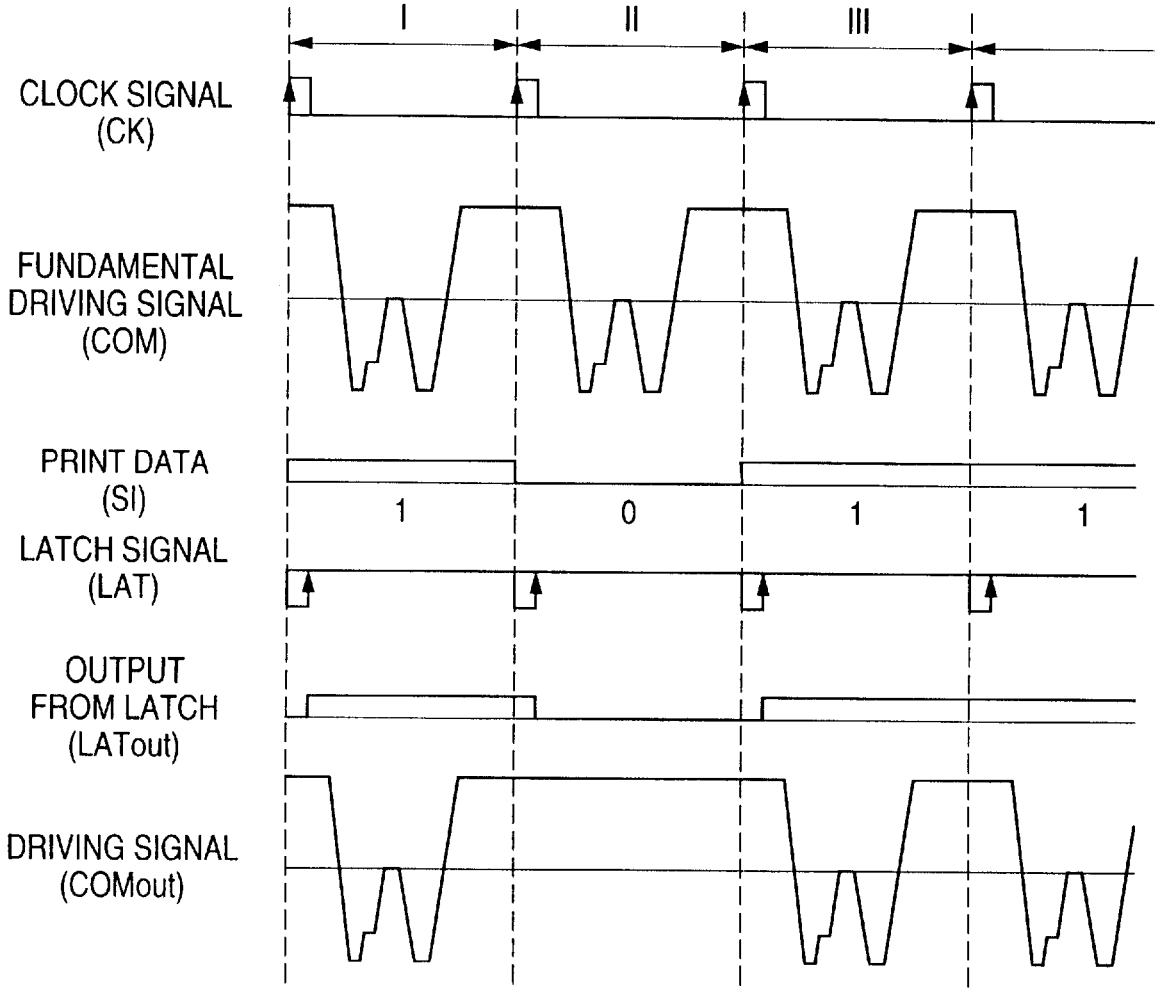
FIGS. 4*a* and 4*b* show an example of the waveform of a driving signal in accordance with the first embodiment of the present invention.
Figure 4:
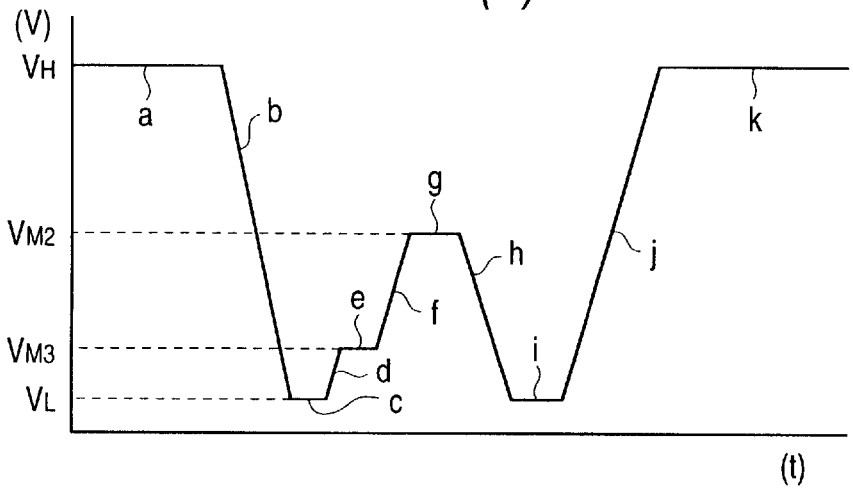

An example of the waveform of a driving signal (COMout) shown in detail in FIG. 4(*b*) is a waveform suitable for jetting a smaller ink droplet. The driving signal is provided with a first hold process a for gently raising and maintaining voltage between the lower electrode 4 and the upper electrode 6 from zero volt to the highest voltage $V_H$, for example up to approximately 30 V before a printed condition so as to hold the pressure generating chamber 2 the most expanded condition. The driving signal applies a predetermined voltage including the highest voltage $V_H$ if necessary during printing as described later and after printing is finished, the driving signal lowers voltage from the highest voltage $V_H$ to 0 V.

Figure 5:
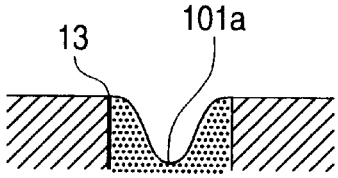
FIGS. 5*a*–5*d* are sectional views, respectively, showing the shape of an ink droplet jetted from a nozzle opening.
Figure 5:
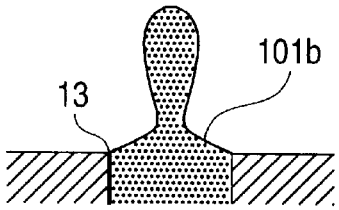
Figure 5:
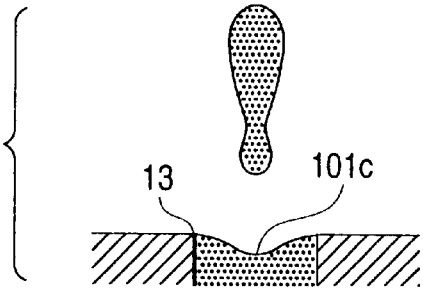
Figure 5:
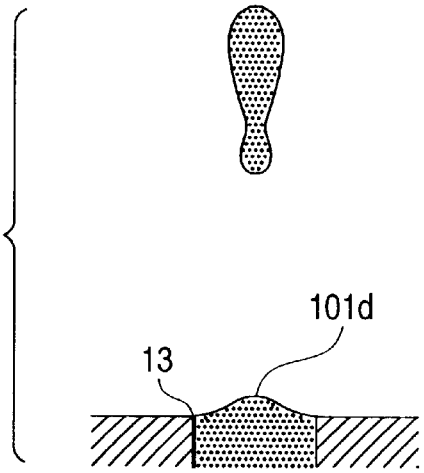

Next, the driving waveform is provided with a preparatory process b for rapidly drawing a meniscus 101*a* at the nozzle opening 13 on the side of the pressure generating chamber 2 up to the maximum as shown in FIG. 5(*a*) by lowering the voltage between both electrodes up to the lowest voltage $V_L$, for example approximately 0 V and a second hold process c for holding this condition in the search for the timing of jetting an ink droplet.

Next, the driving signal raises the voltage between both electrodes up to a third intermediate voltage $V_{M3}$, for example approximately 5 V in a first contraction process d to contract the pressure generating chamber 2. In this process, as shown in FIG. 5(*b*), a small ink droplet is jetted by reaction upon the retraction of a meniscus 101*b* and applying small contraction the quantity of the retraction of which is 50% or less to the pressure generating chamber 2. The holding time of the second hold process c between the preparatory process b and the first contraction process d is set so that ink droplet jetting speed is the highest.

The driving waveform is provided with a second contraction process f for contracting the pressure generating chamber 2 by raising voltage between both electrodes up to second intermediate voltage $V_{M2}$, for example approximately 15 V through a third hold process e after the first contraction process d. In this process, as shown in FIG. 5(*c*), the retraction by reaction upon the first contraction process d of a meniscus 101*c* is reduced.

Next, the driving waveform is provided with a first expansion process h for inhibiting the vibration of a meniscus 101*d* shown in FIG. 5(*d*) by lowering voltage between both electrodes up to the lowest voltage $V_L$ through a fourth hold process g after the second contraction process f.

Afterward, the driving waveform is provided with a hold process k for holding a condition in which the pressure generating chamber 2 is most contracted by again raising voltage between both electrodes up to the highest voltage $V_H$ in a third contraction process j through a fifth hold process i.

According to the above driving waveform, as the second contraction process f is provided after the first contraction process d for jetting an ink droplet, the retraction of the meniscus 101*c* drawn after the first contraction process d can be reduced, the mixture of bubbles from a nozzle and others can be prevented and the stability of jetting can be greatly improved.

To jet a small ink droplet as described above, the pressure generating chamber 2 is required to be rapidly expanded in the preparatory process b and ink is also required to be jetted in the quantity of contraction equivalent to 50% or less of the quantity of expansion in the first contraction process d.

Therefore, it is desirable that the duration of the preparatory process b is equivalent to ½ or less of Helmholtz vibrational cycle Tc of the pressure generating chamber 2 and it is desirable that the duration of the first contraction process d and the duration of the second contraction process f are respectively equivalent to ⅓ or less of Helmholtz vibrational cycle Tc of the pressure generating chamber 2. It is desirable that the time from when the first contraction process d is started until the second contraction process f is started be approximately equal to the Helmholtz vibrational cycle Tc or less of the pressure generating chamber 2 and it is further desirable that the above time be between ¼ and ¾ of Tc.

The quantity of contraction in the first contraction process d is equivalent to 50% or less of the quantity of expansion in the preparatory process b and it is desirable that the above quantity of contraction is equivalent to 45%.

In the meantime, the second contraction process f is provided to reduce the retraction of a meniscus after ink is jetted. Therefore, the second contraction process f is started between time $t_1$ at which time the backing of a meniscus is started and time $t_2$ at which time the meniscus backs most after an ink droplet is jetted from a nozzle opening. It is desirable that the second contraction process f start between time $t_1$ and time $[t_1+(t_2-t_1)\times 3/4]$ and it is further desirable that the above process start between time $t_1$ and time $[t_1+(t_2-t_1)/2]$. If the second contraction process f is started at the above time, the retraction of a meniscus can be effectively inhibited.

In this embodiment, the vibration of a meniscus after jetting is inhibited by providing the first expansion process h after the second contraction process f.

If the time since the first contraction process d is started until the first expansion process h is started is substantially equal to the Helmholtz vibrational cycle Tc of the pressure generating chamber 2, that is, equivalent to the integral times of Tc, a large effect is acquired. It is desirable that the first expansion process h start at a time in which a meniscus backs most after an ink droplet is jetted from a nozzle opening. It is further desirable that the duration of the first expansion process h be equivalent to ½ or less of the Helmholtz vibrational cycle Tc of the pressure generating chamber 2. This is because vibration is effectively inhibited.

The above driving method does not limit the type of waveform of a driving signal and a driving signal may also have a rectangular waveform in addition to a trapezoidal waveform as shown in the drawings.

The structure of the ink-jet recording head which can realize the driving method according to the present invention is also not particularly limited. For example, the present invention can also be applied to an ink-jet recording head wherein a piezoelectric actuator is formed on a silicon substrate in place of the ceramic substrate in a thin film process and a pressure generating chamber is formed by anisotropic etching, and the structure for the supply of ink such as the position of a nozzle opening and the position of a reservoir and others are also not particularly limited.

Figure 6:
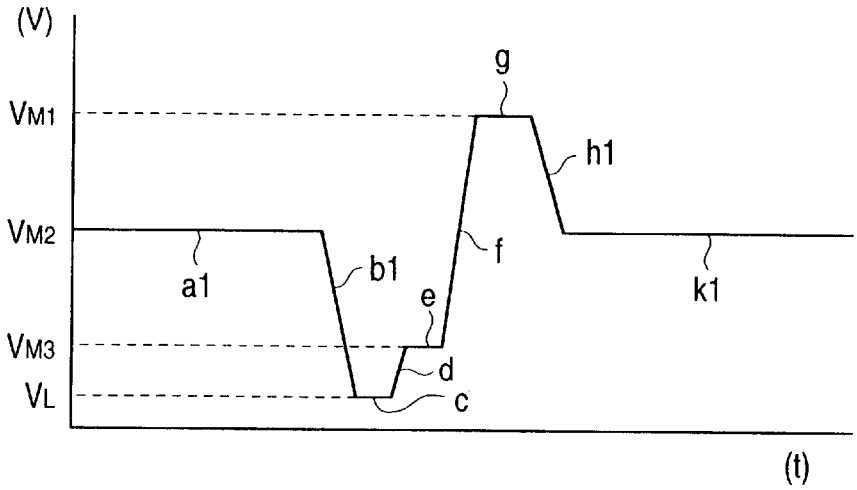
FIG. 6 shows an example of a waveform of a driving signal according to a second embodiment of the present invention.

FIG. 6 shows an example of a waveform of a driving signal in accordance with a second embodiment of the present invention.

This driving waveform is provided with a first hold process a1 for holding an intermediate condition between a condition in which a pressure generating chamber 2 is most contracted and a condition in which it is most expanded by holding the voltage between a lower electrode 4 and an upper electrode 6 at a second intermediate voltage $V_{M2}$, for example approximately 15 V. A preparatory process b1 through a fourth hold process g are similar to the corresponding steps in the first embodiment, however, a hold process k1 for holding an intermediate condition between a condition in which the pressure generating chamber 2 is most contracted and a condition in which it is most expanded by again lowering voltage between both electrodes up to the second intermediate voltage $V_{M2}$ in the first expansion process h1 is provided.

In this embodiment, a small ink droplet can also be jetted at high speed and the vibration of a meniscus after ink is jetted can be also prevented. In this case, as the waveform starts and ends at a second intermediate voltage $V_{M2}$, only an intermediate voltage is applied in case no driving signal is applied and/or the applied voltage is lower than that in the first embodiment. As a result, there is an effect to enhance the reliability of a piezoelectric element and to extend the life of the element as well.

Figure 7:
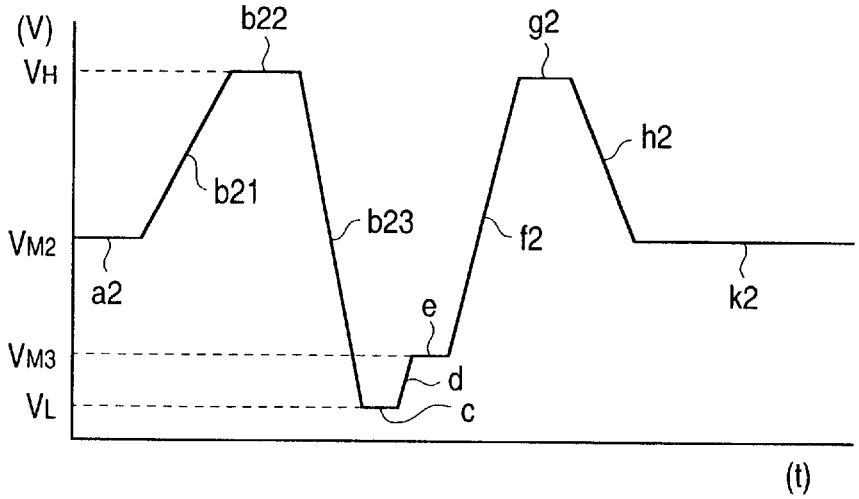
FIG. 7 shows an example of a waveform of a driving signal according to a third embodiment of the present invention.

FIG. 7 shows an example of a waveform of a driving signal in accordance with a third embodiment of the present invention.

This driving waveform is provided with a first hold process a2 for holding an intermediate condition between a condition in which a pressure generating chamber 2 is most contracted and a condition in which it is most expanded by holding the voltage between a lower electrode 4 and an upper electrode 6 at a second intermediate voltage $V_{M2}$, for example approximately 15 V. Subsequently, there is provided a preparatory contraction process b21 by raising the voltage of both electrodes up to the highest voltage $V_H$, for example approximately 30 V. Then, a preparatory hold process b22 for holding the pressure generating chamber at a condition in which it is most expanded and a preparatory expansion process b23 by lowering voltage between both electrodes up to the lowest voltage $V_L$, for example approximately 0 v, is provided. Further, the driving waveform is provided with a hold process k2 for holding the pressure generating chamber 2 at an approximately intermediate condition between a condition in which the pressure generating chamber 2 is most contracted and a condition in which it is most expanded by again lowering the voltage between both electrodes up to the second intermediate voltage $V_{M2}$ in a first expansion process h2 through a fourth hold process g2 for holding the pressure generating chamber 2 at a condition in which it is most contracted by raising the voltage between both electrodes up to the highest voltage $V_H$ in a second contraction process f2.

In this embodiment, a small ink droplet can also be jetted at high speed by rapidly inclining the preparatory expansion process b23 and setting the quantity of contraction in a first contraction process d to 50% or less of the quantity of expansion in the preparatory expansion process b23. The vibration of a meniscus after ink is jetted can be prevented by the second contraction process f2. In this embodiment, a difference in voltage in the preparatory expansion process b23 is larger than a difference in the second embodiment and a meniscus can be greatly drawn on the side of the pressure generating chamber 2 and a smaller ink droplet can be acquired.

Figure 8:
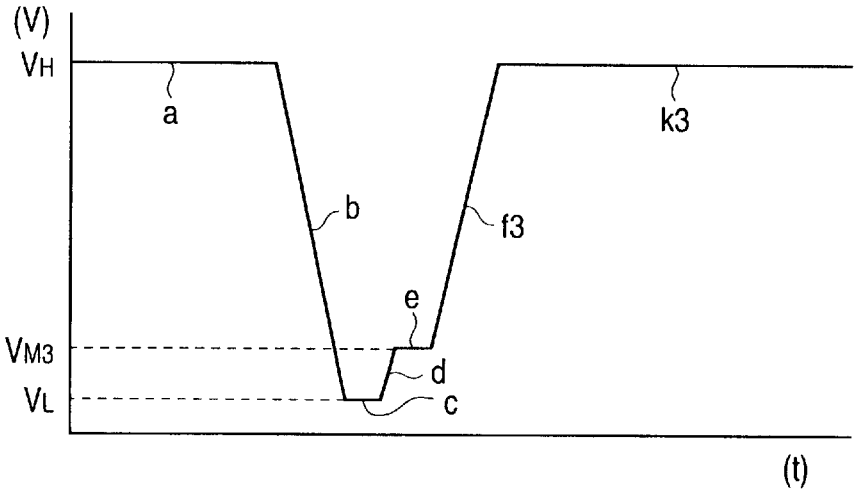
FIG. 8 shows an example of a waveform of a driving signal according to a fourth embodiment of the present invention.

FIG. 8 shows an example of a waveform of a driving signal in accordance with a fourth embodiment of the present invention.

This driving waveform is similar to the driving waveform in the first embodiment up to a third hold process e, however, the driving waveform is provided with a hold process k3 for holding a pressure generating chamber 2 at a condition in which it is most contracted by raising the voltage between a lower electrode 4 and an upper electrode 6 up to the highest voltage $V_H$ in a second contraction process f3.

In this embodiment, a small ink droplet can be jetted at high speed and the retraction of a meniscus after ink is jetted can be inhibited. In this embodiment, the curve of the driving waveform is smaller, compared with that in the first embodiment and the time from a start point to an end point is also short. However, if the viscosity of the ink is high, vibration can be sufficiently inhibited by the waveform.

Figure 9:
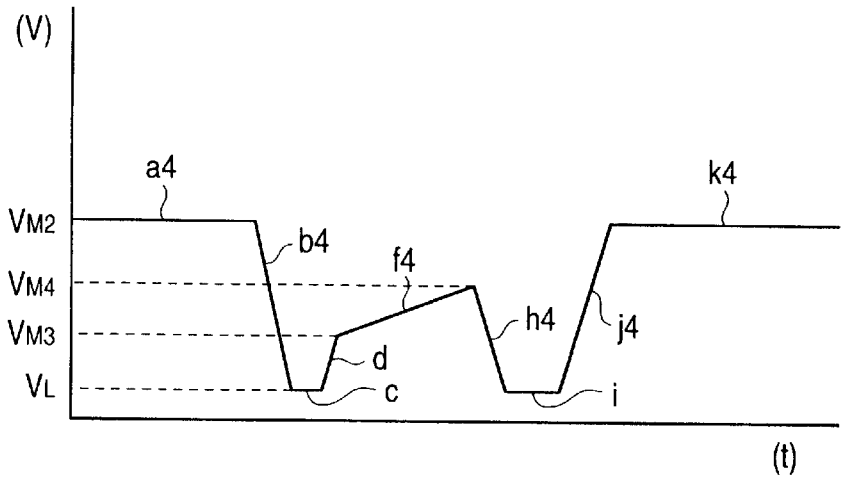
FIG. 9 shows an example of a waveform of a driving signal according to a fifth embodiment of the present invention.

FIG. 9 shows an example of a waveform of a driving signal in accordance with a fifth embodiment of the present invention.

This driving waveform is provided with a first hold process a4 for holding a pressure generating chamber 2 at an intermediate condition between a condition in which the pressure generating chamber 2 is most contracted and a condition in which it is most expanded by maintaining the voltage between a lower electrode 4 and an upper electrode 6 so that it is at a second intermediate voltage $V_{M2}$, for example approximately 15 V. Afterward, a second hold process c is provided by lowering the voltage between both electrodes up to the lowest voltage $V_L$, for example approximately 0 V in a preparatory process b4. Next, after an ink droplet is jetted in a first contraction process d by raising the voltage between both electrodes up to a third intermediate voltage $V_{M3}$, for example approximately 5 V, a second contraction process f4 is continued until the voltage between both electrodes is raised up to a fourth intermediate voltage $V_{M4}$, for example approximately 10 V. Afterward, the driving waveform is provided with a hold process k4 for holding the pressure generating chamber 2 at an intermediate condition between a condition in which the pressure generating chamber 2 is most contracted and a condition in which it is most expanded by raising the voltage between both electrodes up to a second intermediate voltage $V_{M2}$ in a third contraction process j4 through a fifth hold process i by lowering the voltage between both electrodes up to the lowest voltage $V_L$ in a first expansion process h4.

In this embodiment, a small ink droplet can also be jetted at high speed by setting the quantity of contraction in the first contraction process d to 50% or less of the quantity of expansion in the preparatory process b4. The second contraction process f4 after ink is jetted is not provided to prevent the vibration of a meniscus after ink is jetted as in the above embodiments, however, the vibration of a meniscus after ink is jetted can be prevented by the first expansion process h4, the fifth hold process i and the third contraction process j4.

Figure 10:
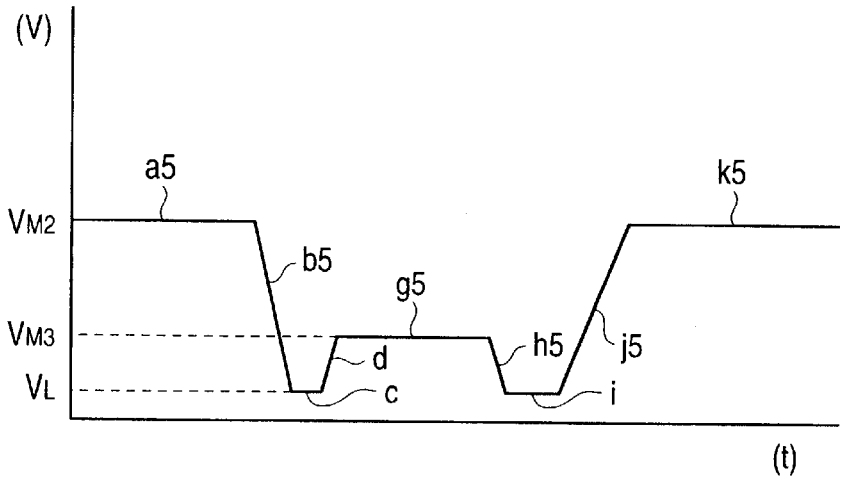
FIG. 10 shows an example of a waveform of a driving signal according to a sixth embodiment of the present invention.

FIG. 10 shows an example of a waveform of a driving signal in accordance with a sixth embodiment of the present invention.

This driving waveform is provided with a first hold process a5 for holding a pressure generating chamber 2 an approximately intermediate condition between a condition in which the pressure generating chamber 2 is most contracted and a condition in which it is most expanded by maintaining the voltage between a lower electrode 4 and an upper electrode 6 at a second intermediate voltage $V_{M2}$, for example approximately 15 V as in the fifth embodiment and afterward, a second hold process c is provided by lowering the voltage between both electrodes up to the lowest voltage $V_L$, for example approximately 0 V in a preparatory process b5. Next, after the voltage between both electrodes is raised up to a third intermediate voltage $V_{M3}$ for example approximately 5 V in a first contraction process d and an ink droplet is jetted, a fourth hold process g5 is provided to search the timing of a first expansion process h5 and the voltage between both electrodes is lowered up to the lowest voltage $V_L$ in the first expansion process h5. Next, after a fifth hold process i, a hold process k5 for holding the pressure generating chamber 2 at an intermediate condition between a condition in which the pressure generating chamber 2 is most contracted and a condition in which it is most expanded by raising voltage between both electrodes up to a second intermediate voltage $V_{V2}$ in a third contraction process j5 is provided.

This embodiment is similar to the fifth embodiment in that a small ink droplet can be jetted at high speed and the vibration of a meniscus after ink is jetted can also be prevented.

In the above embodiments, the retraction of a meniscus or the vibration of a meniscus after ink is jetted is prevented, however, the present invention is not limited to this and after ink is jetted, a reference state may be also naturally gently restored.

The present invention is not limited to the ink-jet recording head depending upon the flexural displacement-type piezoelectric actuator and can be also applied to the driving of a longitudinal displacement-type ink-jet recording head.

Figure 11:
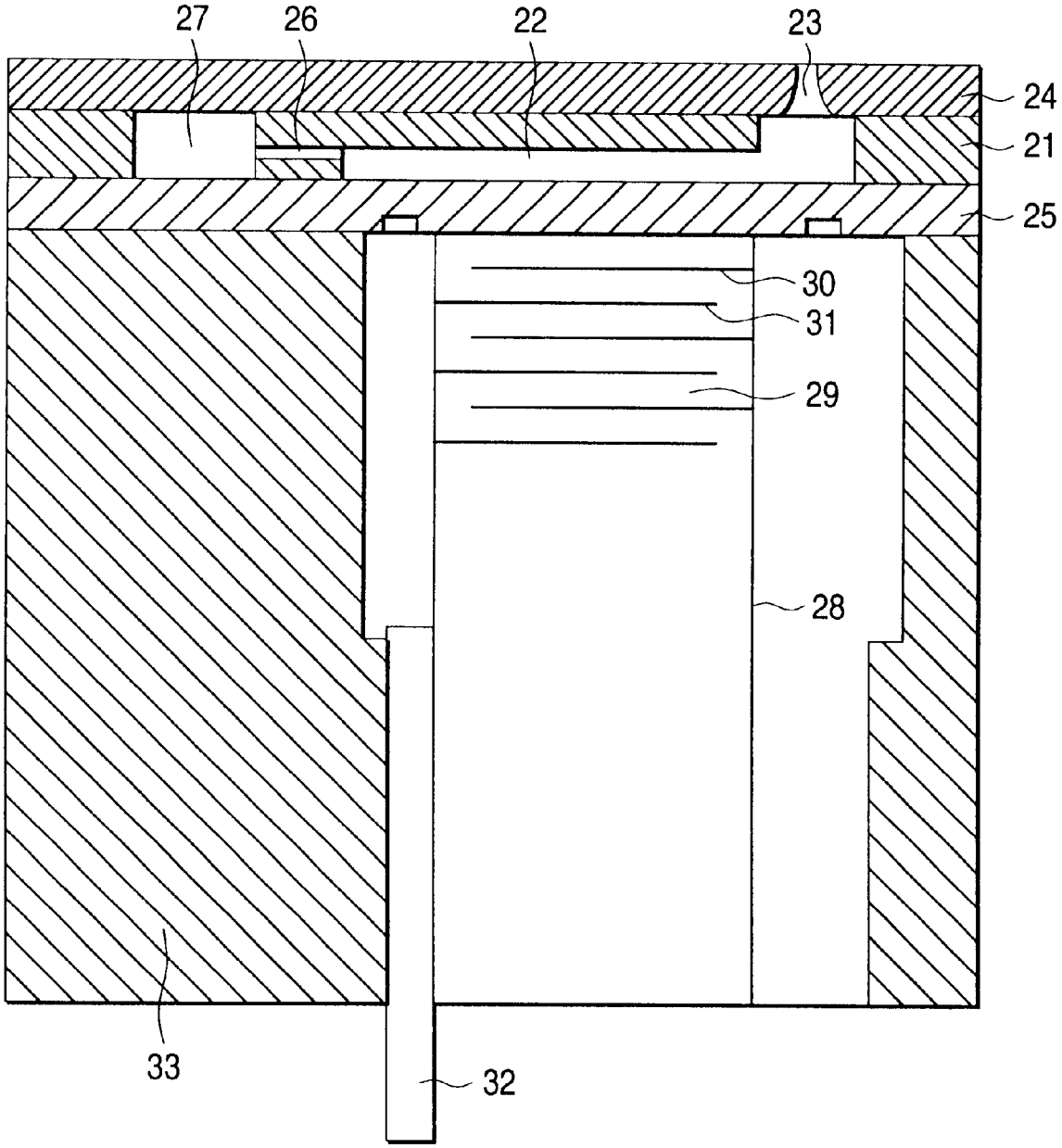
FIG. 11 is a sectional view showing an example of an ink-jet recording head according to another embodiment of the present invention.

FIG. 11 shows an example of an ink-jet recording head provided with a longitudinal vibration-type piezoelectric actuator. As shown in FIG. 11, a pressure generating chamber 22 is formed inside a spacer 21 and both sides of the spacer 21 are respectively sealed by a nozzle plate 24 provided with nozzle openings 23 and a diaphragm 25. A reservoir 27 communicating with the pressure generating chamber 22 via an ink supply port 26 is formed inside the spacer 21 and an ink tank not shown is connected to the reservoir 27.

In the meantime, the end of a piezoelectric element 28 is touched to the side opposite the pressure generating chamber 22 of the diaphragm 25. The piezoelectric element 28 is composed so that it has a laminated structure by inserting piezoelectric material 29 between electrode forming materials 30 and 31 and an inactive area which does not contribute to vibration is fixed to a fixed substrate 32. The fixed substrate 32, the diaphragm 25, the spacer 21 and the nozzle plate 24 are integrated via a base 33.

In the ink-jet recording head composed as described above, as the piezoelectric element 28 is extended on the side of the nozzle plate 24 when voltage is applied to the electrode forming materials 30 and 31 of the piezoelectric element 28, the diaphragm 25 is displaced and the volume of the pressure generating chamber 22 is compressed. Therefore, ink can be made to flow into the pressure generating chamber 22 from the reservoir 27 via the ink supply port 26 by applying the voltage of approximately 30 V for example from a state in which voltage is released beforehand and contracting the piezoelectric element 28. Afterward, the piezoelectric element 28 is extended by applying voltage, the pressure generating chamber 22 is contracted by the diaphragm 25 and an ink droplet can be jetted from a nozzle opening 23.

Therefore, even in case such an ink-jet recording head is driven, a relatively small ink droplet can be jetted without lowering speed by using the above driving method.

In the above ink-jet recording head, the pressure generating chamber is contracted by applying voltage, however, the driving method according to the present invention can be also applied to a driving method of an ink-jet recording head wherein a pressure generating chamber is expanded by applying voltage.

Figure 12:
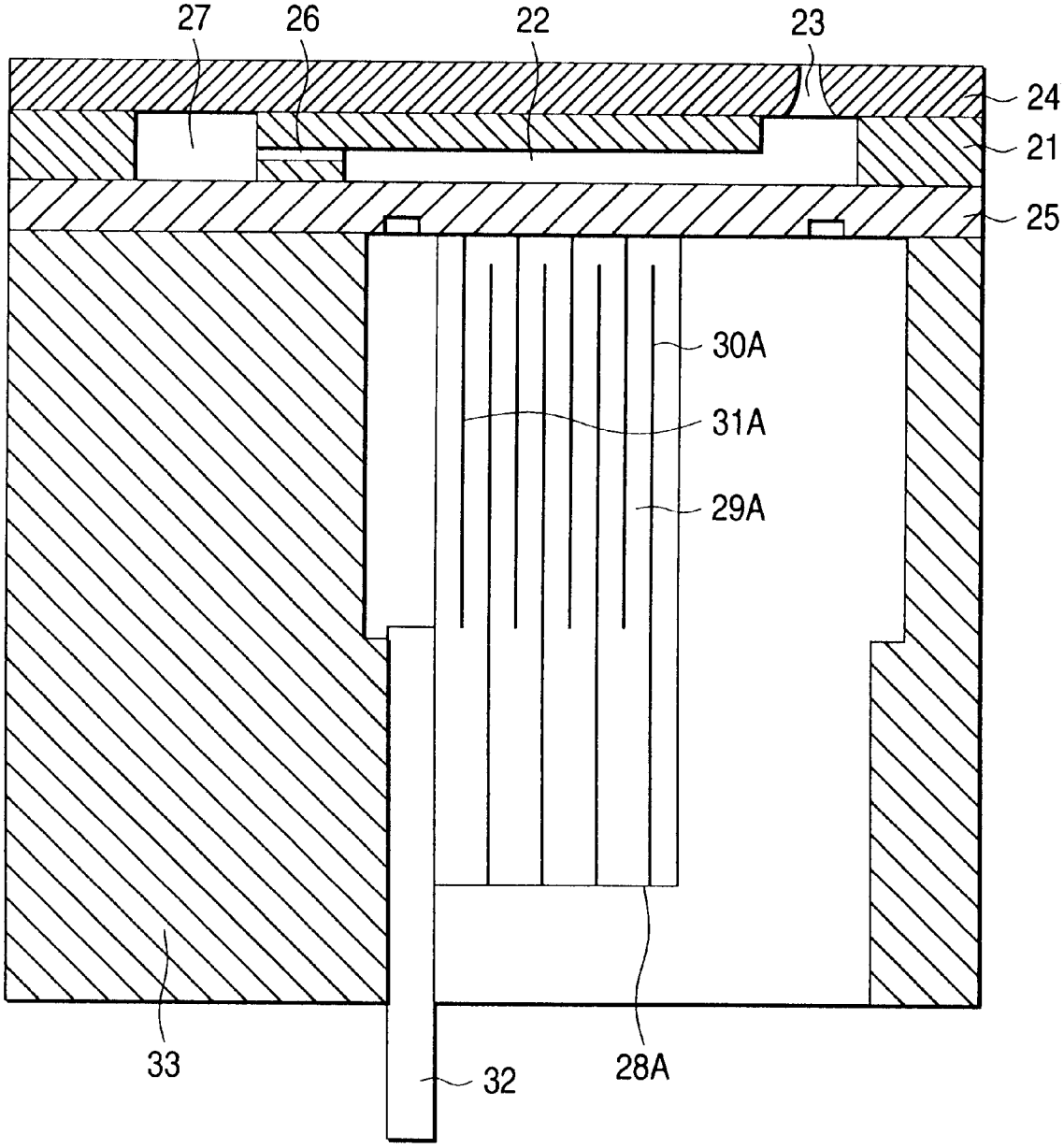
FIG. 12 is a sectional view showing an example of an ink-jet recording head according to yet another embodiment of the present invention.

FIG. 12 shows an example of an ink-jet recording head provided with such structure. The ink-jet recording head shown in FIG. 12 is provided with similar structure except that a piezoelectric element 28A is provided in place of the piezoelectric element 28 shown in FIG. 11. The piezoelectric element 28A is laminated by alternately longitudinally arranging electrode forming materials 30A and 31A in piezoelectric material 29A. Therefore, when voltage is applied to both electrode forming materials 30A and 31A, the piezoelectric element 28A is contracted, a pressure generating chamber 22 is expanded and when the application of voltage is released from this state, the pressure generating chamber 22 is contracted and an ink droplet can be jetted from a nozzle opening 23. The similar driving method can be executed by reversing the application and the release of voltage in contraction and expansion in the above driving method.

Figure 13:
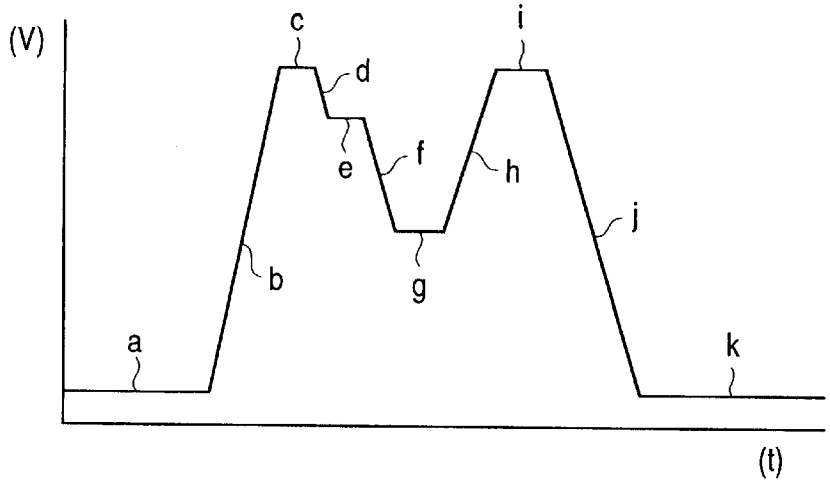
FIGS. 13*a*–13*c* show an example of the waveform of a driving signal according to an embodiment of the present invention.
Figure 13:
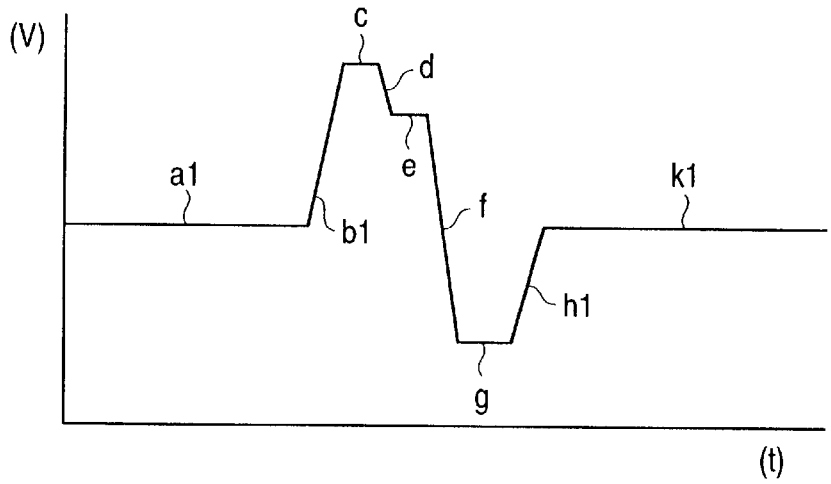
Figure 13:
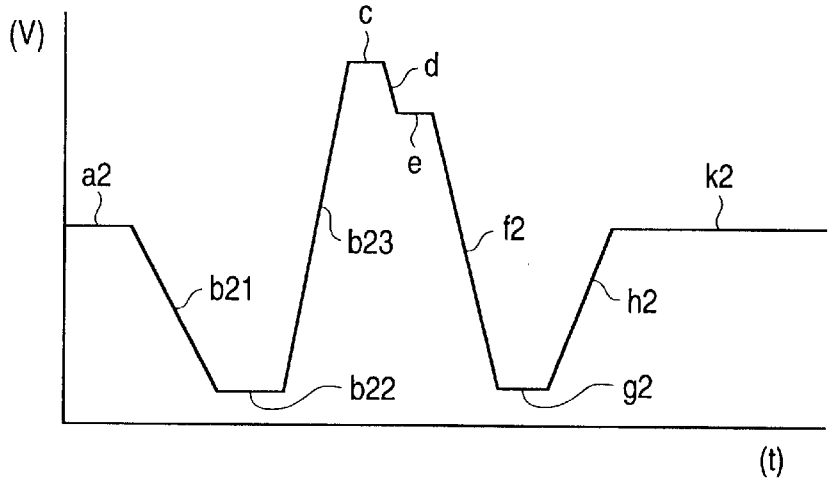
Figure 14:
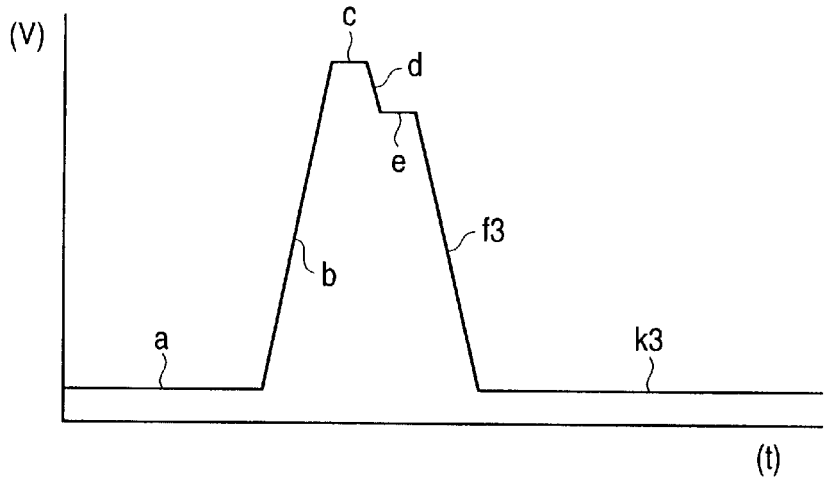
FIGS. 14*a*–14*c* show an example of the waveform of a driving signal according to an embodiment of the present invention.
Figure 14:
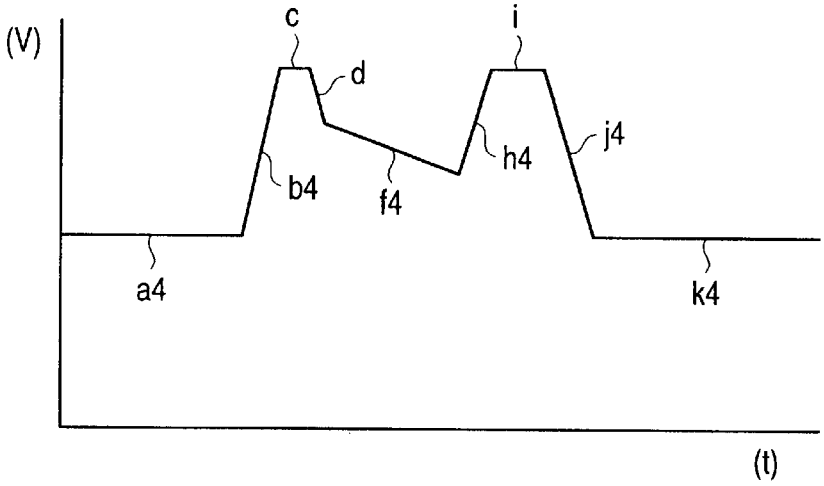
Figure 14:
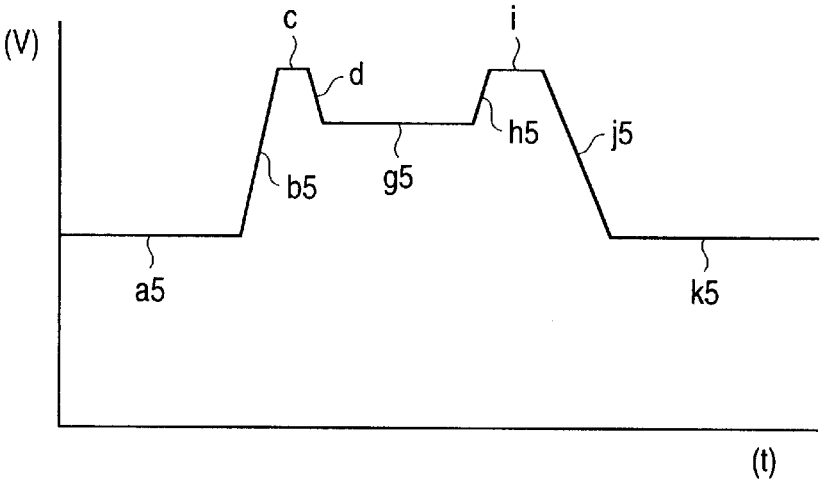

FIGS. 13 and 14 respectively show an example of a driving signal applied to such an ink-jet recording head. FIGS. 13 and 14 correspond to FIGS. 4 and 6 to 10, the same reference number is allocated to a process producing the similar action and the description is omitted. In this case, FIGS. 13 and 14 are different in that voltage is applied differently from the above case in a preparatory process b and a first expansion process h for example and conversely, the application of voltage is released in a first contraction process d for example, and the effect of action is similar to that in the above case.

As described above, according to the present invention, as the quantity of variation in the contraction process is set to 50% or less of the quantity of expansion in the preparatory process, effect that the quantity of ink composing an ink droplet can be reduced as much as possible without deteriorating the flying speed of an ink droplet, a dot suitable for graphic printing can be formed and residual vibration can be greatly reduced is produced.

It is contemplated that numerous modifications may be made to the ink jet recording head driving method and device of the present invention without departing from the spirit and scope of the invention as defined in the following claims.

What is claimed is:

1. An ink-jet recording head driving method for contracting a pressure generating chamber and jetting an ink droplet by driving a piezoelectric element provided on said pressure generating chamber communicating with a nozzle opening and a reservoir, said method comprising the step of:

preparing to jet ink by expanding said pressure generating chamber and backing a meniscus into the pressure generating chamber direction before a first contraction process that contracts said pressure generating chamber and jets said ink from said nozzle opening, wherein the time in which a driving signal is applied during said preparing step is approximately ½ or less of the Helmholtz vibrational cycle Tc of said pressure generating chamber, and a volume of contraction in said first contraction process is 50% or less of the quantity of expansion in said preparing step, and wherein vibration of said meniscus is substantially eliminated after said ink has been jetted.

2. An ink-jet recording head driving method according to claim 1, further comprising a second contraction process that stabilizes the meniscus.

3. An ink-jet recording head driving method according to claim 2, wherein:

said second contraction process is started between a time at which the backing of a meniscus starts, and a time at which the meniscus backs most respectively after the end of an ink droplet is jetted from said nozzle opening.

4. An ink-jet recording head driving method according to claim 2, wherein:

said second contraction process is started before a time period, wherein said time period is ¾ times a length of a time period between a time at which the backing of the meniscus starts and a time at which the backing of said meniscus is at a maximum after an ink droplet is jetted from said nozzle opening, is elapsed from the time at which the backing of said meniscus starts.

5. An ink-jet recording head driving method according to claim 2, wherein:

said second contraction process is started before a time period, wherein said time period is ½ times a length of a time period between a time at which the backing of the meniscus starts and a time at which the backing of said meniscus is at a maximum after an ink droplet is jetted from said nozzle opening, is elapsed from the time at which the backing of said meniscus starts.

6. An ink-jet recording head driving method according to claim 2, wherein after said second contraction process, a first expansion process is provided to expand said pressure generating chamber so that a vibration after ink is jetted is inhibited.

7. An ink-jet recording head driving method according to claim 6, wherein a time between the start of said first contraction process and the start of said first expansion process is substantially equivalent to a Helmholtz vibrational cycle Tc of said pressure generating chamber.

8. An ink-jet recording head driving method according to claim 7, wherein after said first expansion process, a third contraction process is provided to contract said pressure generating chamber so that a vibration after ink is jetted is inhibited.

9. An ink-jet recording head driving method according to claim 1, wherein after said first contraction process, a second contraction process is provided to gently contract said pressure generating chamber to a certain defined state including a reference condition existing before said preparing step.

10. An ink-jet recording device, comprising:

an ink-jet recording head expanding or contracting a pressure generating chamber by driving a piezoelectric element provided on said pressure generating chamber communicating with a nozzle opening and a reservoir and jetting an ink droplet from said nozzle opening; and a driver that executes a preparing step that prepares to jet said ink by expanding said pressure generating chamber and backing a meniscus into the pressure generating chamber direction and a first contraction process that jets ink from said nozzle aperture by contracting said pressure generating chamber and outputting a driving signal such that a duration that said driving signal is applied in said preparing step is equivalent to ½ or less of a Helmholtz vibrational cycle Tc of said pressure generating chamber and a volume of contraction in the first contraction process is substantially 50% or less of the quantity of expansion in said preparing step by said piezoelectric element, and wherein vibration of said meniscus is substantially eliminated after said ink has been jetted.

11. An ink-jet recording device according to claim 10, wherein said driver performs a second contraction process to stabilize the meniscus.

12. An ink-jet recording device according to claim 11, wherein:

said second contraction process is started between a time when the backing of a meniscus starts, and a time when the backing of said meniscus is at a maximum after an ink droplet is jetted from said nozzle opening.

13. An ink-jet recording device according to claim 11, wherein:

said second contraction process is started before a time period, wherein said time period is ¾ times a length of a time period between a time at which the backing of the meniscus starts and a time at which the backing of said meniscus is at a maximum after an ink droplet is jetted from said nozzle opening, is elapsed from the time at which the backing of said meniscus starts.

14. An ink-jet recording device according to claim 11, wherein:

said second contraction process is started before a time period, wherein said time period is ½ times a length of a time period between a time at which the backing of the meniscus starts and a time at which the backing of said meniscus is at a maximum after an ink droplet is jetted from said nozzle opening, is elapsed from the time at which the backing of said meniscus starts.

15. An ink-jet recording device according to claim 10, wherein after said first contraction process, a second contraction process is provided to gently contract said pressure generating chamber to a certain defined state including a reference state existing before said preparing step.

16. An ink-jet recording device according to claim 10, wherein said driver performs a first expansion process for expanding said pressure generating chamber so that a vibration after the jetting of ink is inhibited after said second contraction process.

17. An ink-jet recording device according to claim 16, wherein a time between the start of said first contraction process and the start of said first expansion process is substantially equivalent to a Helmholtz vibrational cycle Tc of said pressure generating chamber.

18. An ink-jet recording device according to claim 16, wherein after said first expansion process, a third contraction process is provided for contracting said pressure generating chamber so that vibration after the jetting of ink is inhibited.

19. An ink-jet recording device according to claim 10, wherein before and after the start of each of said preparing step and said first contraction process, a predetermined voltage is applied to said piezoelectric actuator.

20. An ink-jet recording device according to claim 10, wherein said pressure generating chamber is contracted by applying a predetermined voltage to said piezoelectric actuator to deform said piezoelectric actuator.

21. An ink-jet recording device according to claim 10, wherein said pressure generating chamber is contracted by discharging a predetermined voltage applied to said piezoelectric actuator to deform said piezoelectric actuator.

22. An ink-jet recording head driving method for contracting a pressure generating chamber and jetting an ink droplet by driving a piezoelectric element provided on said pressure generating chamber communicating with a nozzle opening and a reservoir, said method comprising the steps of;

preparing to jet ink by expanding said pressure generating chamber and backing a meniscus into the pressure generating chamber direction before a first contraction process that contracts said pressure generating chamber and jets said ink from said nozzle opening; and a second contraction process that stabilizes the meniscus, wherein the time in which a driving signal is applied during said preparing step is approximately ½ or less of the Helmholtz vibrational cycle Tc of said pressure generating chamber, and a volume of contraction in said first contraction process is 50% or less of the quantity of expansion in said preparing step, vibration of said meniscus is substantially eliminated after said ink has been jetted, and wherein said second contraction process is started between a time at which the backing of a meniscus starts, and a time at which the meniscus backs most respectively after the end of an ink droplet is jetted from said nozzle opening.

23. The ink-jet recording head driving method of claim 22, wherein:

said second contraction process is started before a time period, wherein said time period is ¾ times a length of a time period between a time at which the backing of the meniscus starts and a time at which the backing of said meniscus is at a maximum after an ink droplet is jetted from said nozzle opening, is elapsed from the time at which the backing of said meniscus starts.

24. The ink-jet recording head driving method of claim 22, wherein:

said second contraction process is started before a time period, wherein said time period is ½ times a length of a time period between a time at which the backing of the meniscus starts and a time at which the backing of said meniscus is at a maximum after an ink droplet is jetted from said nozzle opening, is elapsed from the time at which the backing of said meniscus starts.

25. The method of claim 22, wherein after said first contraction process, a second contraction process is provided to gently contract said pressure generating chamber to a certain defined state including a reference condition existing before said preparing step.

26. The method of claim 22, wherein after said second contraction process, a first expansion process is provided to expand said pressure generating chamber so that a vibration after ink is jetted is inhibited.

27. The method of claim 26, wherein a time between the start of said first contraction process and the start of said first expansion process is substantially equivalent to a Helmholtz vibrational cycle Tc of said pressure generating chamber.

28. The method of claim 27, wherein after said first expansion process, a third contraction process is provided to contract said pressure generating chamber so that a vibration after ink is jetted is inhibited.

29. An ink-jet recording device, comprising:

an ink-jet recording head expanding or contracting a pressure generating chamber by driving a piezoelectric element provided on said pressure generating chamber communicating with a nozzle opening and a reservoir and jetting an ink droplet from said nozzle opening; and a driver that executes a preparing step that prepares to jet said ink by expanding said pressure generating chamber and backing a meniscus into the pressure generating chamber direction and a first contraction process that jets ink from said nozzle aperture by contracting said pressure generating chamber and outputting a driving signal such that a duration that said driving signal is applied in said preparing step is equivalent to ½ or less of a Helmholtz vibrational cycle Tc of said pressure generating chamber and a volume of contraction in the first contraction process is substantially 50% or less of the quantity of expansion in said preparing step by said piezoelectric element, vibration of said meniscus is substantially eliminated after said ink has been jetted, and wherein said driver performs a second contraction process to stabilize the meniscus, said second contraction process being started between a time when the backing of a meniscus starts, and a time when the backing of said meniscus is at a maximum after an ink droplet is jetted from said nozzle opening.

30. The device of claim 29, wherein:

said second contraction process is started before a time period, wherein said time period is ¾ times a length of a time period between a time at which the backing of the meniscus starts and a time at which the backing of said meniscus is at a maximum after an ink droplet is jetted from said nozzle opening, is elapsed from the time at which the backing of said meniscus starts.

31. The device of claim 29, wherein:

said second contraction process is started before a time period, wherein said time period is ½ times a length of a time period between a time at which the backing of the meniscus starts and a time at which the backing of said meniscus is at a maximum after an ink droplet is jetted from said nozzle opening, is elapsed from the time at which the backing of said meniscus starts.

32. The device of claim 29, wherein after said first contraction process, a second contraction process is provided to gently contract said pressure generating chamber to a certain defined state including a reference state existing before said preparing step.

33. The device of claim 29, wherein said driver performs a first expansion process for expanding said pressure generating chamber so that a vibration after the jetting of ink is inhibited after said second contraction process.

34. The device of claim 33, wherein a time between the start of said first contraction process and the start of said first expansion process is substantially equivalent to a Helmholtz vibrational cycle Tc of said pressure generating chamber.

35. The device of claim 33, wherein after said first expansion process, a third contraction process is provided for contracting said pressure generating chamber so that vibration after the jetting of ink is inhibited.

36. The device of claim 29, wherein before and after the start of each of said preparing step and said first contraction process, a predetermined voltage is applied to said piezoelectric actuator.

37. The device of claim 29, wherein said pressure generating chamber is contracted by applying a predetermined voltage to said piezoelectric actuator to deform said piezoelectric actuator.

38. The device of claim 29, wherein said pressure generating chamber is contracted by discharging a predetermined voltage applied to said piezoelectric actuator to deform said piezoelectric actuator.

* * * * *

UNITED STATES PATENT AND TRADEMARK OFFICE

CERTIFICATE OF CORRECTION

PATENT NO. : 6,328,398 B1
DATED : December 11, 2001
INVENTOR(S) : Junhua Chang

It is certified that error appears in the above-identified patent and that said Letters Patent is hereby corrected as shown below:

Title page,
Item [75], delete "Junhau" and insert -- Junhua --.

Signed and Sealed this

Twenty-eighth Day of January, 2003

JAMES E. ROGAN
*Director of the United States Patent and Trademark Office*